US007415740B1

(12) United States Patent
Kemper

(10) Patent No.: US 7,415,740 B1
(45) Date of Patent: Aug. 26, 2008

(54) SAFETY BED

(76) Inventor: Gary M. Kemper, 941 Vicksburg St., Deltona, FL (US) 32725

( * ) Notice: Subject to any disclaimer, the term of this patent is extended or adjusted under 35 U.S.C. 154(b) by 0 days.

(21) Appl. No.: 11/797,915

(22) Filed: May 8, 2007

(51) Int. Cl.
*A47C 21/08* (2006.01)
*A47D 7/02* (2006.01)

(52) U.S. Cl. ..... 5/424; 5/100; 5/425

(58) Field of Classification Search ..... 5/100, 5/424, 425, 428
See application file for complete search history.

(56) References Cited

U.S. PATENT DOCUMENTS

| | | | | | |
|---|---|---|---|---|---|
| 1,465,414 | A | | 8/1923 | Boardman | |
| 1,695,571 | A | * | 12/1928 | Baxter | 5/100 |
| 2,289,132 | A | * | 7/1942 | Lehman, Jr. et al. | 5/100 |
| 2,329,475 | A | * | 9/1943 | Lehman, Jr. et al. | 5/93.1 |
| 2,369,834 | A | * | 2/1945 | Lundin | 5/100 |
| 4,811,436 | A | * | 3/1989 | Schwartz | 5/93.1 |
| 4,959,878 | A | * | 10/1990 | Essek | 5/424 |
| 5,146,632 | A | | 9/1992 | Li | |
| 5,617,593 | A | | 4/1997 | Pham | |
| 5,926,870 | A | | 7/1999 | Branca-Barnes et al. | |
| 6,167,580 | B1 | | 1/2001 | Draheim et al. | |
| 6,453,491 | B1 | | 9/2002 | Wells et al. | |
| 6,487,735 | B1 | * | 12/2002 | Jacques et al. | 5/424 |
| 6,505,360 | B2 | | 1/2003 | Guillot | |
| 6,611,976 | B2 | * | 9/2003 | Guillot | 5/100 |

* cited by examiner

*Primary Examiner*—Michael Trettel
(74) *Attorney, Agent, or Firm*—William M. Hobby, III

(57) ABSTRACT

A safety bed apparatus has upper and lower panels which can be lowered below the level of the mattress for easy egress and ingress into the bed. A grooved track is mounted to each of the two bed posts, each having a grooved track mounted thereon and each having a pair of generally vertically extending parallel grooves therein. Each vertically extending groove has a plurality of downwardly angled grooves extending therefrom and ending with a generally vertical locking notch. The top and bottom entry panels each have a plurality of pins on the edges thereof which slide in the vertical grooves and into the angled grooves and locking notches to lock the top panel over the bottom panel in a raised position.

14 Claims, 5 Drawing Sheets

SAFETY BED

FIELD OF THE INVENTION

This invention relates to a safety bed and especially to a safety bed having upper and lower entry panels which entry panels can be raised and lowered and when lowered are below the top level of the mattress of the bed.

BACKGROUND OF THE INVENTION

Safety beds such as baby cribs and beds found in medical facilities and geriatric facilities normally include a guard rail assembly which can be raised to prevent the patient from falling out of the bed and lowered to allow the patient to ingress and egress the bed. For instance, baby cribs typically include a top side that can be dropped into a lowered position to facilitate placing the baby in or removing the baby from the crib and then can be lifted to a raised position and locked in the raised position. Many different guiding and locking arrangements have been developed for guiding the vertical sliding motion of a drop side and for locking the gate in the raised position. Some of these prior locking mechanisms have employed a pair of spring loaded pins fixed to the upper bar of the drop side and engageable with holes or recesses in a fixed structure of the crib. In this type of mechanism, both pins must be simultaneously disengaged from the holes or recesses in order to drop the gate. The safety beds for medical facilities include a guard rail assembly which typically has the top and bottom horizontal rails in a series of spaced vertical bars therebetween to form a lattice-type structure. Strict governmental standards have been specifically mandated for the construction of safety beds. Even so, patient's have on occasion fallen from beds. Safety beds are not only used in a hospital or similar environment but are also used in the home for elderly and disabled person and as cribs for holding a baby.

The present invention provides a safety bed having tall sides with a pair of entry panels sliding in tracks which can be lifted and slid from below the mattress level for easy patient access and locked in place with one panel atop the other.

In the past, there have been numerous patents for safety beds and cribs which have entry panels and guard rails which are raised or lowered to allow the entry of a patient. These include the Draheim et al. U.S. Pat. No. 6,167,580 for a crib dropside assembly and a method of installation. The dropside is secured to opposing pairs of tracks with each track including a pair of generally parallel grooves, one of which extends substantially below the other to allow the dropside pins to slide from one to the other for holding the dropside in a raised position. In the Guillot U.S. Pat. No. 6,505,360 a crib has a drop side and guiding and locking mechanism and a vertically slidable drop side with a guiding or locking mechanism for guiding the vertical movement of the drop side and for locking the gate in a selected position. In the Wells et al. U.S. Pat. No. 6,453,491, a safety bed has a releasable guard rail assembly. The Branca-Barnes et al. U.S. Pat. No. 5,926,870 provides a safety bed for children who are disabled and cannot care for themselves and uses a pair of fold-down plus slide-down side panels hinged together for permitting servicing of the bed. The A. W. Lehman, Jr. et al. U.S. Pat. No. 2,329,475 is for a crib and the method of mounting the sides of the crib. The Pham U.S. Pat. No. 5,617,593 is a device for lifting and lowering a movable side of a baby's bed. The Li U.S. Pat. No. 5,146,632 is a lifting gate control device for a baby's crib while the W. L. Lundin U.S. Pat. No. 2,369,834 is a baby crib having sides extending up above the bed in order to prevent the infant from rolling out of the crib and has a dropside which can be lowered from the outside of the crib by a kick of the foot. In the W. C. Baxter U. S. Pat. No. 1,695,571, a crib is provided in which a side can be raised or lowered through a sliding movement for ready access to the crib. The C. H. Boardman U.S. Pat. No. 1,465,414 is a crib having a hinged top that can be firmly locked when desired.

The present invention provides a safety bed which has a pair of panels on one side thereof which can be rapidly lifted and locked in a raised position and quickly lowered to a position below the top edge of the mattress of the bed for easy access into and out of the bed.

SUMMARY OF THE INVENTION

A safety bed apparatus has a frame having four posts and having three enclosed side panels attached thereto forming an open side between two of the posts. A grooved track is mounted to each of the two posts facing the open side of the frame with each grooved track having a pair of generally vertically extending parallel grooves therein. Each vertically extending groove has a plurality of downwardly angled grooves extending therefrom and ending with a generally vertical locking notch. Top and bottom entry panels each have two end edges and a top and bottom edge. The top and bottom panels each have a plurality of pins extending from each end edge thereof with each top entry panel pin sliding in vertically extending grooves in each entry post and each bottom entry panel pin sliding in the other generally vertical groove in each entry post. The top and bottom entry panels are adapted to slide into a plurality of downwardly angled grooves for locking the top and bottom panels in a raised position. Both the top and bottom entry panels may have two or three or more pins extending from each end thereof for simultaneously sliding into spaced downwardly angled grooves in each groove track. The safety bed top entry panel has a sliding latch attached thereto which aligns with a bore in the groove track for locking the top entry panel in a raised position. Each grooved track also has a pair of shock absorbers attached therebelow and positioned along the bottom of the vertically extending grooves to cushion the lowering of the top and bottom entry panels. Each of the entry panels may have a plurality of transparent windows therein. The raised top panel sits on the raised bottom panel when both panels are raised. The bottom entry panel pins slide in the inner vertically extending parallel grooves which has a lower plurality of the downwardly angled grooves while the top entry panel slides in the outer vertically extending parallel grooves having the upper plurality of downwardly extending grooves for locking the top entry panel in a raised position above the lower entry panel. The safety bed frame supports a mattress therein positioned so that the bottom and top entry panels are below the top of the mattress when in a lowered position. The pins on one side of both the top and bottom entry panels retract against a spring into the panels to allow the panels to be mounted in the grooves of the grooved track of the safety bed apparatus.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
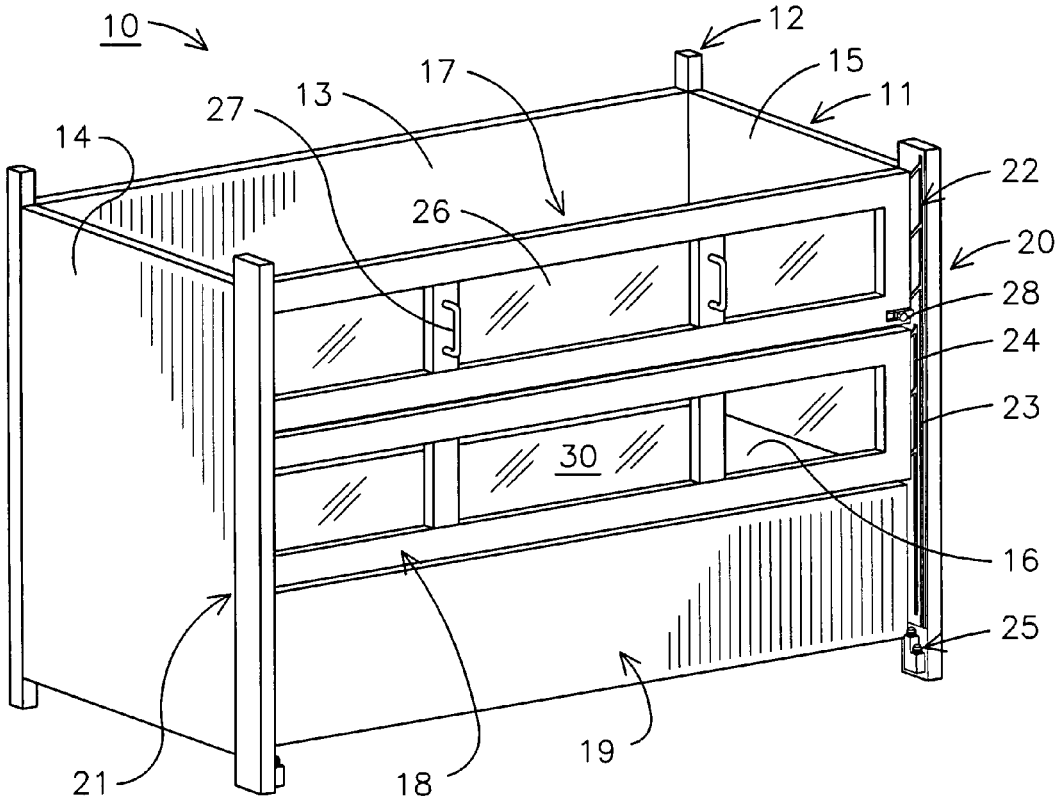
FIG. 1 is a perspective view of a safety bed in accordance with the present invention.

Referring to FIG. 1 of the drawings, the safety bed 10 has a frame 11 having four bed posts 12. The bed post has one fixed side panel 13 and a pair of end panels 14 and 15. The bed has a mattress 16 which may be positioned over a box spring as desired. The bed 10 includes a top entry panel 17 and a bottom entry panel 18 which can be slidably moved from a lower position to a raised position as shown, in FIG. 1, to allow ingress and egress to the bed 10 through the open side of the bed. The bed has a front fixed panel 19. Entry posts 20 and 21 each have a grooved track 22 mounted thereto with each entry track having an outer generally vertical groove 23 and a generally vertical inner groove 24 and each post 20 and 21 has a pair of shock absorbers 25 placed directly below the vertical grooves 23 and 24. The upper panel 17 may have a plurality of transparent windows 26 therein and a pair of handles 27 mounted to the outside of the bed. The upper groove also has a slide lock 28 on one side thereof which has a bolt which slides into a bore within the track 22 to lock the upper panel 17 in a raised position, as shown in FIG. 1. The lower panel 18 may also have a plurality of transparent windows 30 which transparent windows may be made of a transparent polymer, such as polycarbonate plastic.

Figure 2:
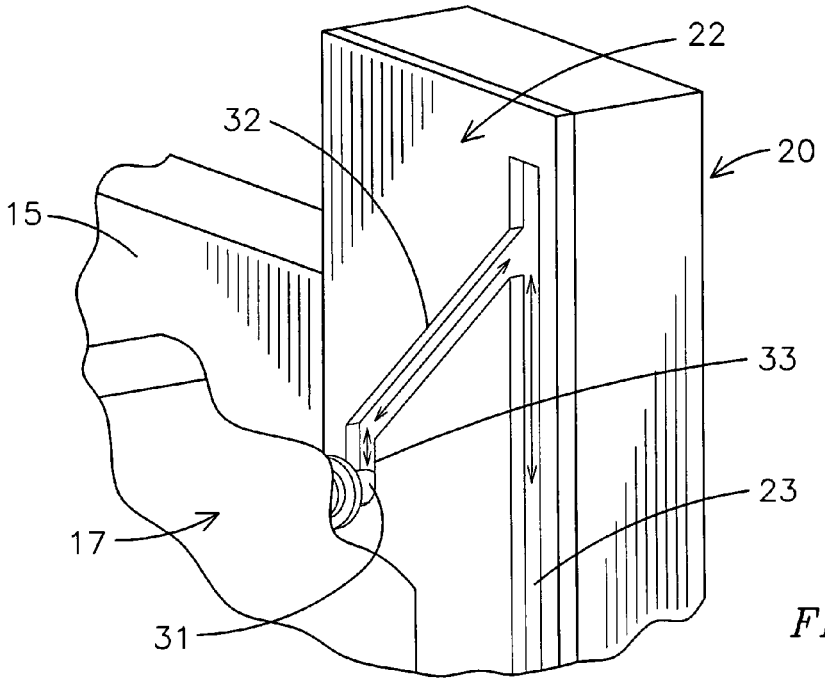
FIG. 2 is a cutaway perspective view of a grooved track portion of the safety bed of FIG. 1.
Figure 3:
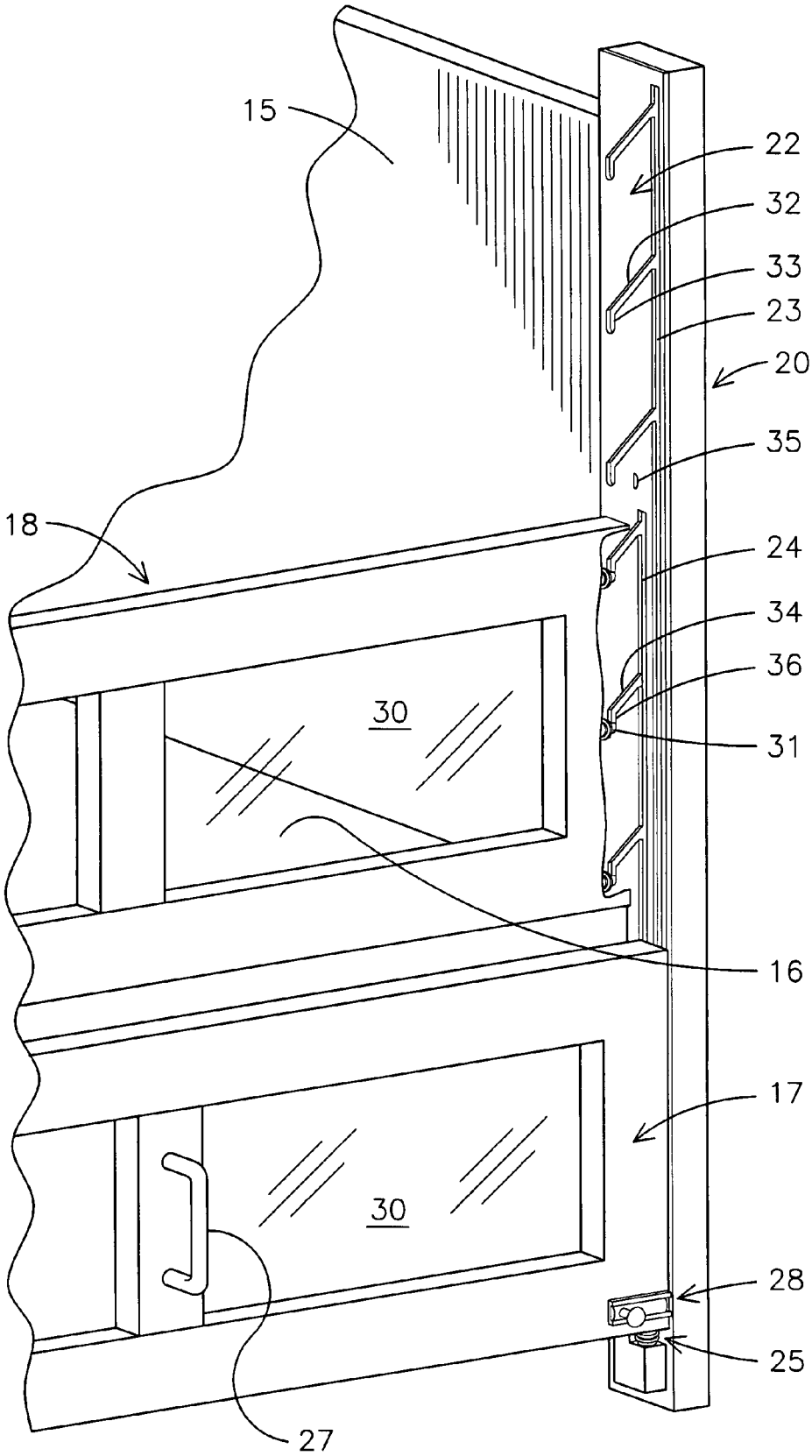
FIG. 3 is a partial cutaway of the safety bed of FIG. 1 showing the grooved track on one side of the bed having the lower panel raised.
Figure 4:
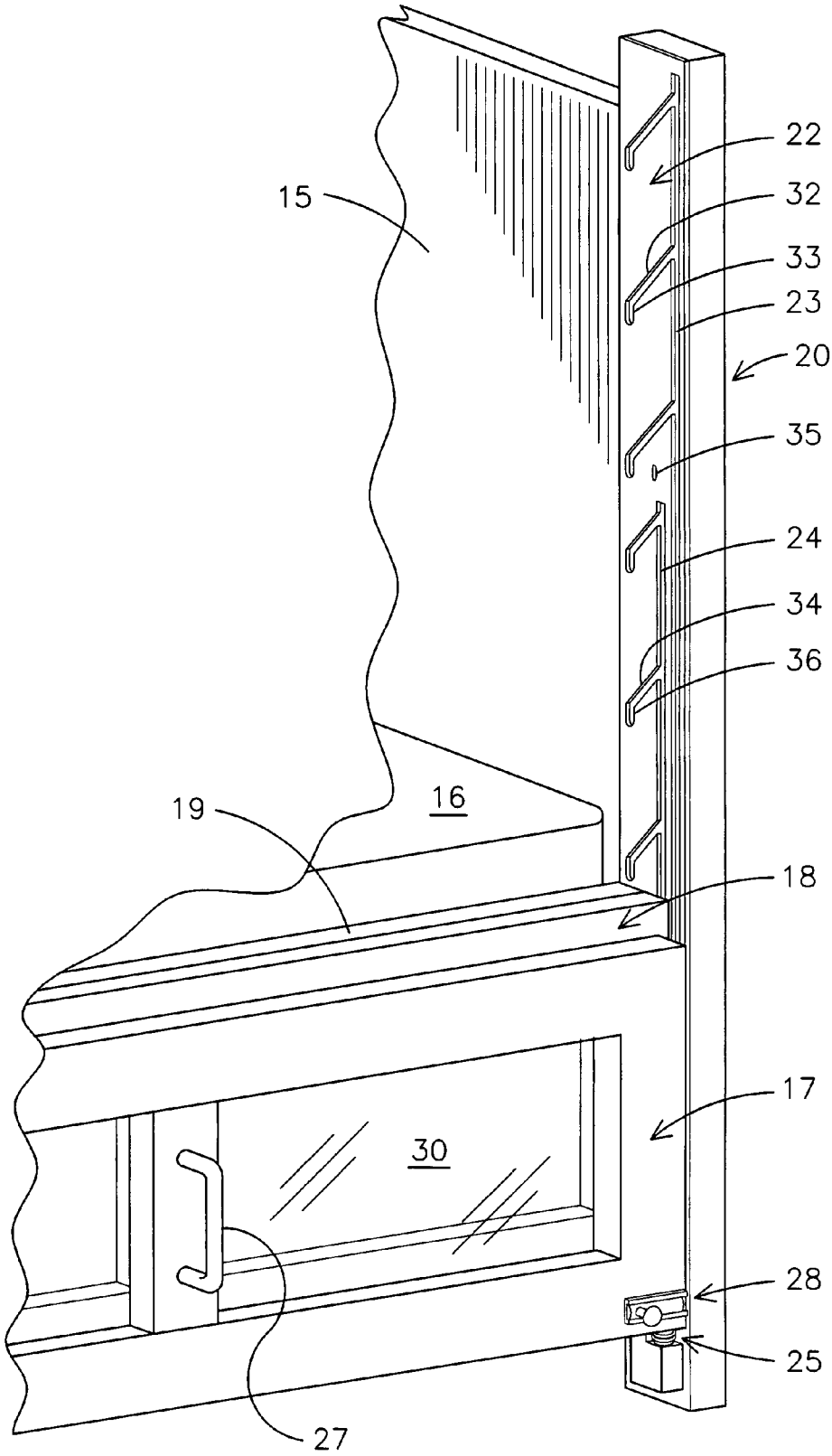
FIG. 4 is a partial perspective view of the safety bed as shown in FIG. 3 with both entry panels lowered.

FIGS. 2, 3 and 4 illustrate the operation of the entry panels 17 and 18. Each panel 17 and 18 has a plurality of pins along each end edge which, on one end, are retractable pins 31 which are retracted into the edge of the panels 17 and 18 against a spring mounted therein to allow the panels 17 and 18 to be mounted within the grooves of the grooved track 22. The outer groove track 23 has a plurality of downwardly angled grooves 32, each ending in a locking notch 33 which may be a slightly downwardly groove extension. As illustrated, there are three downwardly extending groove portions 32 and three downwardly extending groove portions 34 extending from the inner groove 24.

As seen in FIGS. 3 and 4, the lock bore 35 for the sliding bolt lock 28 is shown on the track 22. The top panel 17 and the bottom panel 18 each slide with three pins on each end allowing them to slide in the vertical grooves 23 and 24. The bottom entry panel pins slide into groove 24 and all three pins align and slide into the downwardly angled grooves 34 that intersect the groove 24 allowing the bottom panel 18 to slide into the locking notches 36 where the bottom entry panel 18 is held by three pins on either end. The entry panel 17 is also held by three sliding pins on either end sliding into the angled grooves 32 and notches 33. When the top panel 18 and the bottom panel 17 are in their lowered positioned, as shown in FIG. 4, they are dropped below the top level of the mattress 16 and are dropped onto the pair of shock absorbers 25 mounted on the bottom of the entry posts 20 or 21.

The top panel 17 can be raised from the position shown in FIG. 4 all the way until the pins 31 reach the top of the outer groove 23 and then all three pins simultaneously slide into the angled groove 32 and allow it to drop into the locking notches 33. Similarly, the bottom panel 18 can be raised with all three of its pins on each end of the panel aligning with and sliding in the groove 24 where they can be dropped in the downward angled grooves 34 simultaneously and into the locking notches 36. This allows both the bottom and the top sliding entry panels to be rapidly slid in their respective grooves until they simultaneously slide the three pins into the downwardly angled grooves and into the locking notches providing a rapid raising and lowering of the upper and lower panels and locking both panels in place. The slide bolt lock 28 is moved into the locking bore 35 to lock the top panel in a raised position. This prevents the upper panel 17 pins from being pushed against the angled grooves 32. The upper panel 17 is locked in place directly over the bottom entry panel 18 so that the bottom entry panel 18 is unable to slide up in the angled grooves 34 for lowering the panel, thus locking both panels in place.

Figure 5:
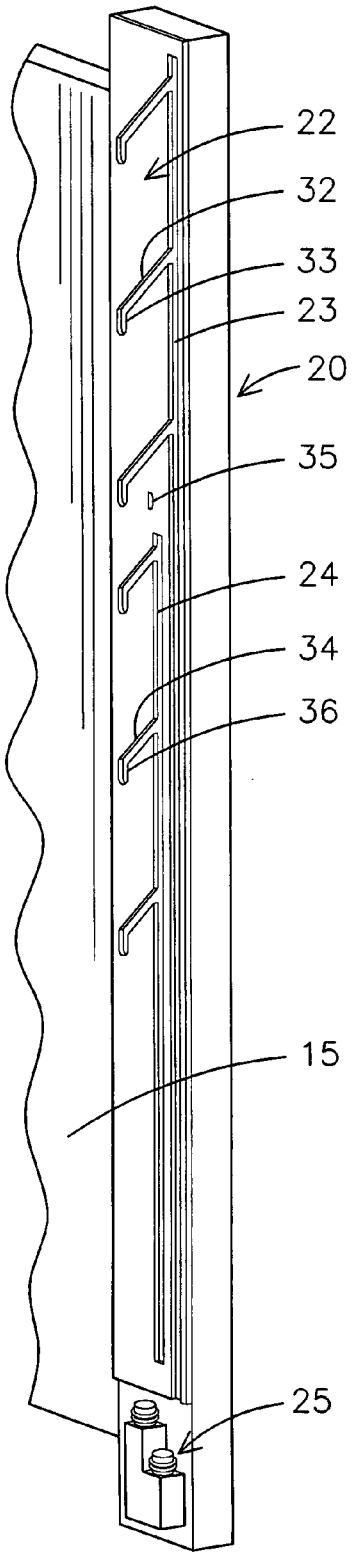
FIG. 5 is a partial perspective view of the grooved tracks of the safety bed of FIG. 1.

Turning to FIG. 5, the bed post 20 is illustrated having a grooved track 22 mounted thereto adjacent the fixed end panel 15. The vertically extending groove 23 is seen being parallel to the vertically extending groove 24 with the outer groove 23 having a plurality of intersecting downwardly angled grooves 32 each ending with a locking notch 33 while the parallel inner vertical groove 24 is seen having the three downwardly angled grooves 34 intersecting the groove 24, each having a locking notch 36 therein. Sliding lock bolt bore 35 is also seen in this figure. It should also be clear that any number of downwardly angled grooves and matching pins can be utilized without departing from the spirit and scope of the invention. For instance, two angled grooves can also be used as well as three or four angled grooves.

Figure 7:
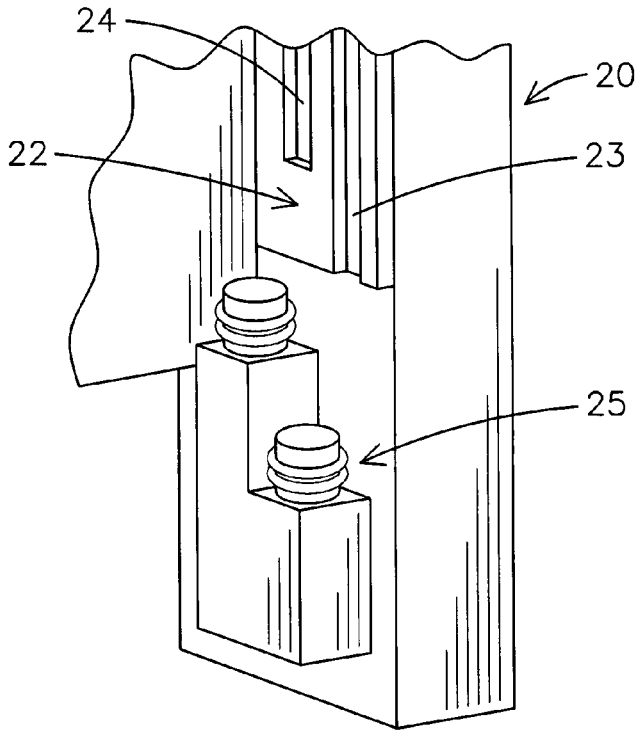
FIG. 7 is a partial perspective view of the shock absorbers mounted to the bottom of the vertical grooves in one of the bed posts.

The dual shock absorbers are illustrated with each shock absorber placed directly below one of the vertical grooves 23 or 24 so that when the entry panels 17 and 18 are lowered, they will slide to lower the door onto the shock absorbers 25 to cushion the lowering of the entry panels. The shock absorbers 25 are more clearly illustrated in FIG. 7 as being placed directly below the vertical groove 23 and the vertical groove 24.

Figure 6:
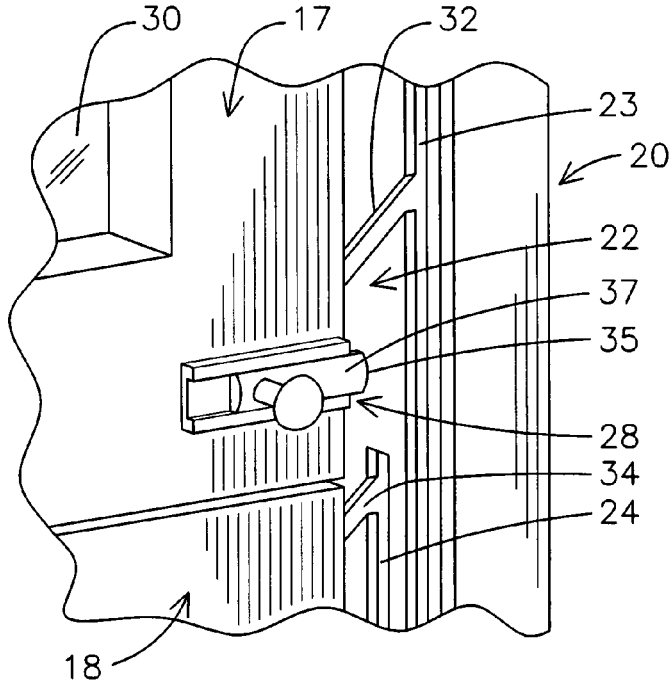
FIG. 6 is a partial cutaway view of a top entry panel lock.

FIG. 6 illustrates the extra locking of the entry panels in a raised position by having a sliding latch 28 sliding a bolt 37 into the locking bore 35 to lock the upper panel in a raised position since the upper panel 17 is directly over the lower panel 18 in their raised positions. Panel 18 is also locked with the lock 28 since it is unable to be lifted and slid upwards in the downwardly angled grooves 34 to reach the vertical groove 24. It will be understood that the lock 28 is a secondary locking source since dropping of the upper and lower panels into the downwardly angled grooves and into the locking notches locks the panels in place.

Figure 8:
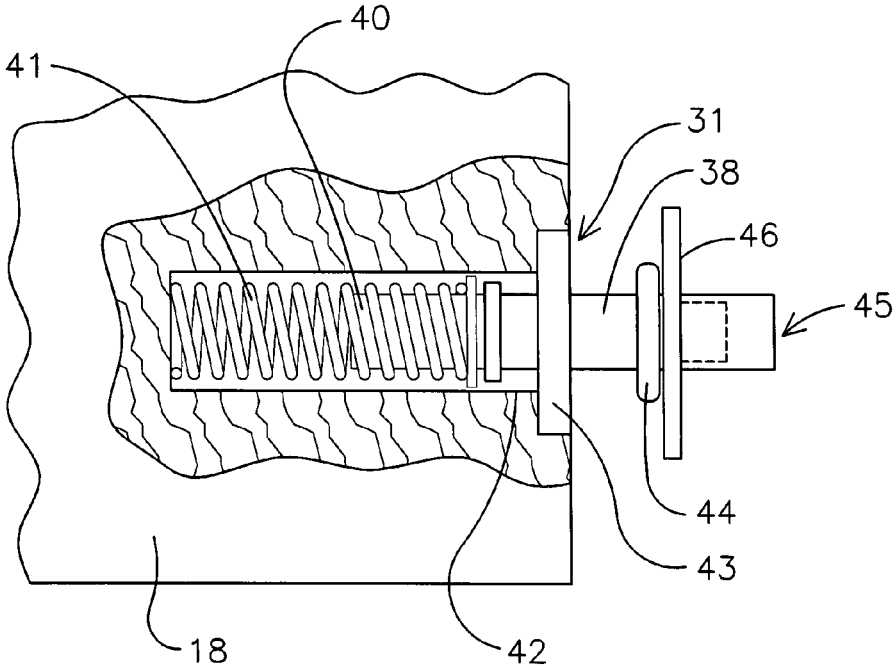
FIG. 8 is a cutaway view of the spring loaded pins for the safety bed.

Turning to FIG. 8, one retractable pin 31 is more clearly illustrated having pin portion 38 extending from a bore 40 within the edge of the panel 18. Bore 40 has a coiled spring 41 mounted therein which presses against an annular flange 42 mounted on the pin 38. Pin 38 slides through a mounting guide 43 and has an annular flange 44 therearound so that a sliding member 45 having a sliding flange 46 thereon can ride on the end of the pin 38. This allows the pin 38 and the sliding cap 45 to be retracted into the bore 40 against the spring 41 to allow the upper and lower panels 17 and 18 to be mounted in the grooves 23 and 24. The constant spring pressure maintains the panels 17 and 18 in the grooves aligned at all times. The pins on the opposite end of the panels 17 and 18 may have fixed pins for sliding within the grooves of the post 21.

It should be clear at this time that a safety bed has been provided which advantageously allows the lowering of the entry panels or railings below the level of the top of the mattress for easy ingress and egress from the bed which simultaneously allows the panels to be raised to a raised position and to be locked in place while providing an extra security lock for both panels with a single latch. However, the present invention is not to be construed as limited to the forms shown which are to be considered illustrative rather than restrictive.

I claim:

1. A safety bed comprising:

a frame having four posts and having three enclosing side panels attached thereto forming an open side between two of said posts;

a grooved track mounted to each of said two posts facing said open side of said frame, each said grooved track having a pair of generally vertically extending parallel grooves therein and each vertically extending groove having a plurality of downwardly angled grooves extending therefrom and each downwardly angled groove having a locking notch on the end thereof;

top and bottom entry panels each having two end edges and a top and bottom edge, said top and bottom panels each having at least one pin extending from each end edge thereof, each said top entry panel pin sliding in one said vertically extending groove on each post and adapted to slide into one of said plurality of downwardly angled grooves for holding said top panel in a raised position and each said bottom entry panel pin sliding in the other generally vertically extending groove on each post and adapted to slide into one of said plurality of downwardly angled grooves to hold said bottom panel in a raised position;

whereby a pair of opening panels can be slid in separate grooves and locked in different positions by the sliding of opening panels pins along a pair of vertically grooves and into angled grooves.

2. A safety bed in accordance with claim 1 in which said top entry panel has two pins extending from each end thereof for simultaneously sliding into two spaced downwardly angled grooves in each grooved track.

3. A safety bed in accordance with claim 2 in which said bottom entry panel has two pins extending from each end thereof for simultaneously sliding into two spaced downwardly angled grooves in each grooved track.

4. A safety bed in accordance with claim 1 in which said top entry panel has three pins extending from each end thereof for simultaneously sliding into three spaced downwardly angled grooves in each grooved track.

5. A safety bed in accordance with claim 2 in which said bottom entry panel has three pins extending from each end thereof for simultaneously sliding into three spaced downwardly angled grooves in each grooved track.

6. A safety bed in accordance with claim 1 in which said top entry panel has a sliding latch attached thereto which aligns with a bore in said groove track when said top entry panel is in a raised position.

7. A safety bed in accordance with claim 6 in which each said grooved track has a pair of shock absorbers attached thereto and positioned along the bottom of said pair of vertically extending grooves to cushion the lowering of said top and bottom entry panels.

8. A safety bed in accordance with claim 1 in which said top and bottom entry panels each has a plurality of transparent windows therein.

9. A safety bed in accordance with claim 1 in which said top entry panel has a raised position sitting on said raised bottom panel.

10. A safety bed in accordance with claim 9 in which said bottom entry panel slides in the inner vertically extending parallel grooves having the lower plurality of downwardly angled grooves.

11. A safety bed in accordance with claim 10 in which said top entry panel slides in the outer vertically extending parallel grooves having the higher plurality of downwardly angled grooves for locking said top entry panel in a raised position above said lower entry panel in a raised position.

12. A safety bed in accordance with claim 11 in which said frame supports a mattress therein and said bottom and top entry panels have a lowered position below the top of said mattress.

13. A safety bed in accordance with claim 1 in which said pins on one edge of said top panel retract thereinto against a spring to thereby allow said top panel to be mounted into said grooved track.

14. A safety bed in accordance with claim 13 in which said pins on one edge of said bottom panel retract thereinto against a spring to thereby allow said top panel to be mounted into said grooved track.

* * * * *